US006425781B1

(12) United States Patent
Bernstein et al.

(10) Patent No.: US 6,425,781 B1
(45) Date of Patent: Jul. 30, 2002

(54) RJ JACK WITH INTEGRATED INTERFACE MAGNETICS

(75) Inventors: Elliot Bernstein, Glen Cove, NY (US); John Chen, Danville, CA (US)

(73) Assignee: Bel-Fuse, Inc., Jersey City, NJ (US)

( * ) Notice: Subject to any disclaimer, the term of this patent is extended or adjusted under 35 U.S.C. 154(b) by 0 days.

(21) Appl. No.: 09/492,895

(22) Filed: Jan. 27, 2000

Related U.S. Application Data

(60) Provisional application No. 60/117,607, filed on Jan. 28, 1999.

(51) Int. Cl.[7] ..... H01R 24/02
(52) U.S. Cl. ..... 439/490; 439/676
(58) Field of Search ..... 439/490, 676; 336/107

(56) References Cited

U.S. PATENT DOCUMENTS

| | | | | |
|---|---|---|---|---|
| 4,772,224 A | | 9/1988 | Talend | |
| 4,978,317 A | | 12/1990 | Pocrass | 439/490 |
| 5,015,204 A | | 5/1991 | Sakamoto et al. | |
| 5,096,441 A | | 3/1992 | Jaag | |
| 5,397,250 A | | 3/1995 | Briones | |
| 5,403,207 A | | 4/1995 | Briones | |
| 5,478,261 A | * | 12/1995 | Bogese, II | 439/676 |
| 5,639,262 A | | 6/1997 | Lim | |
| 5,678,233 A | | 10/1997 | Brown | |
| 5,736,910 A | | 4/1998 | Townsend et al. | |
| 5,759,070 A | | 6/1998 | Belopolsky | |
| 5,766,043 A | * | 6/1998 | Talend | 439/676 |
| 5,971,809 A | * | 10/1999 | Belopolsky et al. | 439/620 |
| 6,062,908 A | * | 5/2000 | Jones | 439/490 X |
| 6,102,741 A | * | 8/2000 | Boutros et al. | 439/676 X |
| 6,116,946 A | * | 9/2000 | Lewis et al. | 439/490 |

FOREIGN PATENT DOCUMENTS

| | | |
|---|---|---|
| JP | 11-283690 | 10/1999 |
| TW | 3079031 | 1/1995 |
| TW | 307055 | 10/1996 |
| WO | 9833242 | 7/1998 |
| WO | 9857489 | 12/1998 |

* cited by examiner

*Primary Examiner*—Renee Luebke
(74) *Attorney, Agent, or Firm*—Ostrolenk, Faber, Gerb & Soffen, LLP

(57) ABSTRACT

An RJ jack includes a first housing having bottom, side, rear, front and top walls defining an interior chamber and an opening through the front wall through which a plug may be received into the interior chamber. A plurality of contact fingers extend from beneath the bottom wall to and over the front wall and into the interior chamber. The spacing between the contact fingers in the interior chamber is equal to the spacing of corresponding contacts in the plug with the spacing of the contact fingers extending beneath the bottom wall being substantially greater. A second housing is removably secured to the rear wall of the first housing, the second housing containing a plurality of magnetic elements. At least two guides for receiving light emitting devices are formed on the rear wall of the second housing. The top wall extends over the first and second housings and has a stopper for limiting movement of the plug within the chamber and a locking mechanism for releasably securing the plug within the chamber, and is transparent for transmitting light from the light emitting devices.

11 Claims, 4 Drawing Sheets

RJ JACK WITH INTEGRATED INTERFACE MAGNETICS

RELATED APPLICATION

This application is based on Provisional Application Ser. No. 60/117,607, filed Jan. 28, 1999, entitled "RJ JACK WITH INTEGRATED FILTER".

BACKGROUND OF THE INVENTION

The present invention relates to RJ jacks and, in particular, to RJ jacks with integrated interface magnetics and associated LEDs.

RJ jacks are modular connectors used in telecommunications and data networks to interconnect equipment units. Typically, the RJ jacks are connected to interface magnetics, such as transformers and filters, and LEDs are usually used as system status indicators. Such LEDs are normally located near the RJ connector and, in some cases, are located within the connector itself, as in, for example, U.S. Patent No. 4,978,317.

A problem with such embedded LEDs is EMI (Electro Magnetic Interference). More specifically, the LEDs are part of the digital circuit and the currents flowing through the LEDs contain a wide spectrum of electronic noise. This noise, together with other noise generated by the digital signals in the system, is present on the LEDs. If the LEDs are in close proximity to the RJ connector pins, as in embedded LED designs, the high frequency noise will be electromagnetically coupled onto the data lines. Moreover, the long LED lead lengths in embedded LED designs can compound the EMI problems.

SUMMARY OF THE INVENTION

It is an object of the present invention to provide an RJ jack which incorporates interface magnetics, and which substantially improves EMI performance and reduces cross talk.

It is another object of the invention to provide such an RJ jack which also incorporates system status indicators by a means other than embedded LEDs.

The foregoing and other objects are achieved by an RJ jack in accordance with one aspect of the present invention which includes a housing having bottom, side, rear, front and top walls and an interior chamber for receiving a plug through an opening in the front wall. A plurality of contact fingers are provided in the interior chamber for making contact with corresponding contacts in the plug. The top wall includes a stopper for limiting movement of the plug within the interior chamber and a locking mechanism for releasably securing the plug within the chamber. The top wall is also transparent and is structured and arranged for transmitting light from light emitting devices.

Other features and advantages of the present invention will become apparent from the following description of the invention which refers to the accompanying drawings.

BRIEF DESCRIPTION OF THE DRAWING

FIG. 1(*b*) is a perspective exploded view of the components of FIG. 1(*a*) assembled with a bottom plate;

FIG. 1(*c*) is a perspective exploded view of the components of FIG. 1(*b*) and a shorting bar assembly;

FIG. 2(*b*) is -a metal shield to be used with the assembled components of FIG. 2(*a*);

FIG. 2(*c*) is a perspective exploded view showing the components of 2(*a*) after assembling thereof with the metal shield of FIG. 2(*b*);

DETAILED DESCRIPTION OF PREFERRED EMBODIMENT(S)

Figure 1A:
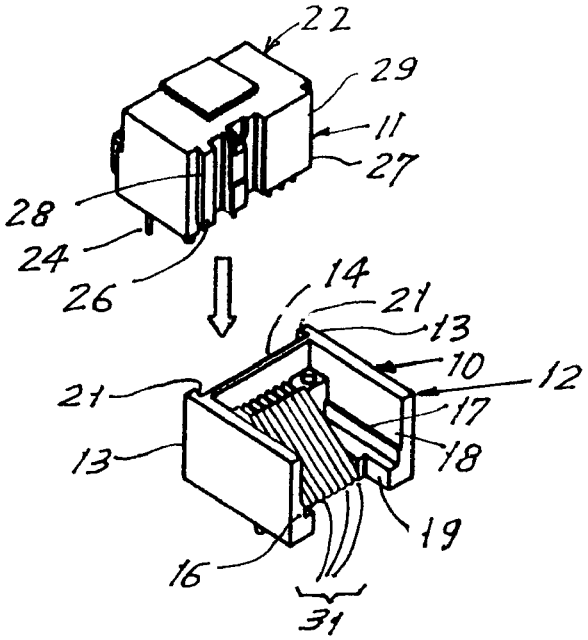
FIG. 1(*a*) is a perspective exploded view showing a contact pin block assembly and a toroid base assembly forming part of an RJ jack in accordance with certain aspects of the invention.
Figure 1B:
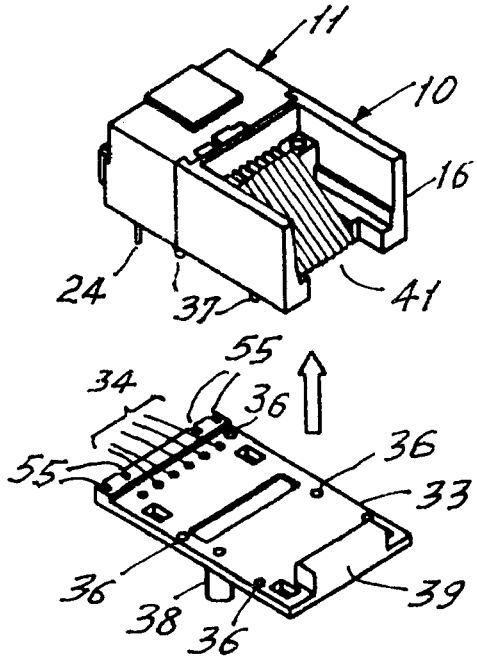
Figure 1C:
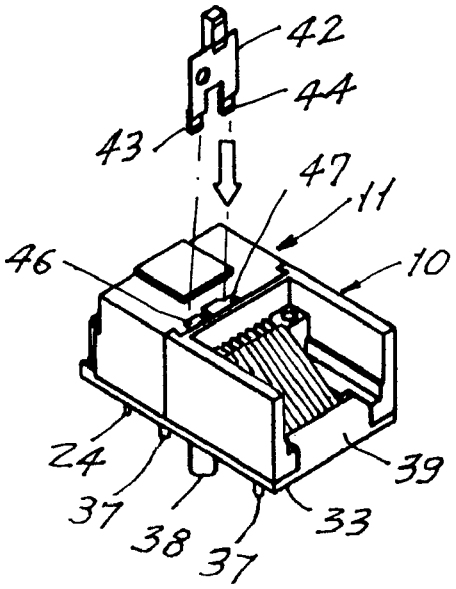
Figure 2A:
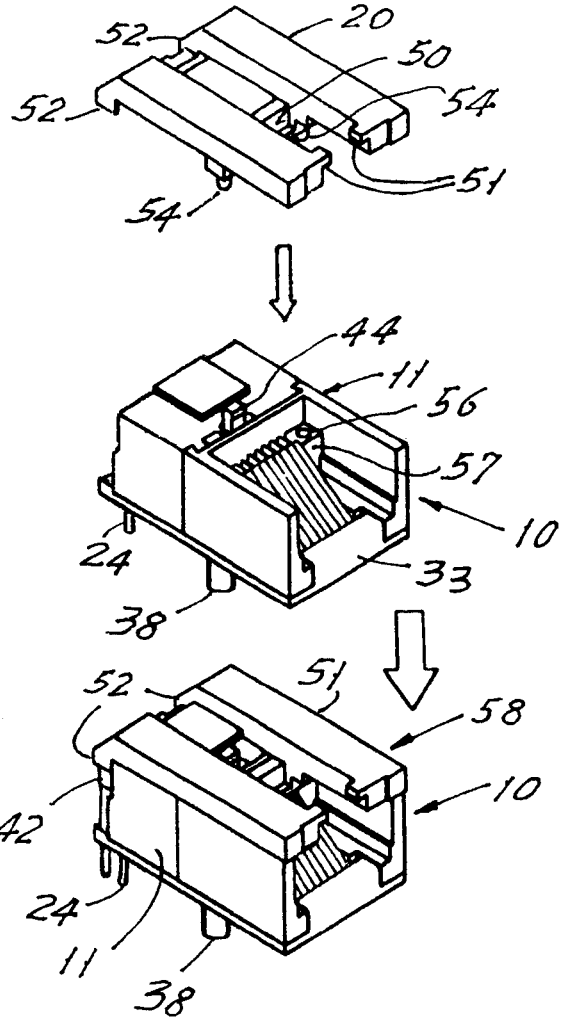
FIG. 2(*a*) is a perspective exploded view of the components of FIG. 1 (*c*) assembled with a top wall.
Figure 2B:
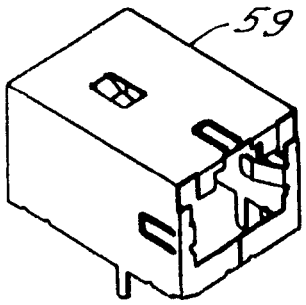
Figure 2C:
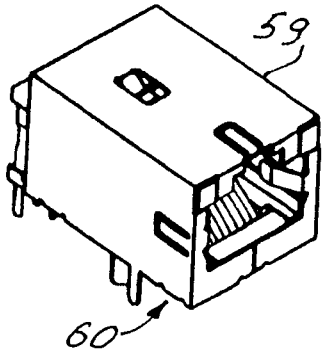

Referring to the drawings and, in particular, to FIG. 1(*a*), there is shown a contact pin block assembly 10 and a toroid base assembly 11 forming part of an RJ jack 58 (FIG. 2(*a*)).

The contact pin assembly 10 includes a one-piece plastic housing 12 having side walls 13, a rear wall 14, a front wall 16 having an interior chamber 17 adapted to receive a modular plug (not shown) through an opening 18 in the front wall 16, and a bottom wall 19. The side walls 13 extend rearwardly beyond the rear wall 14 and have dove-tailed inner edges 21.

Figure 3:
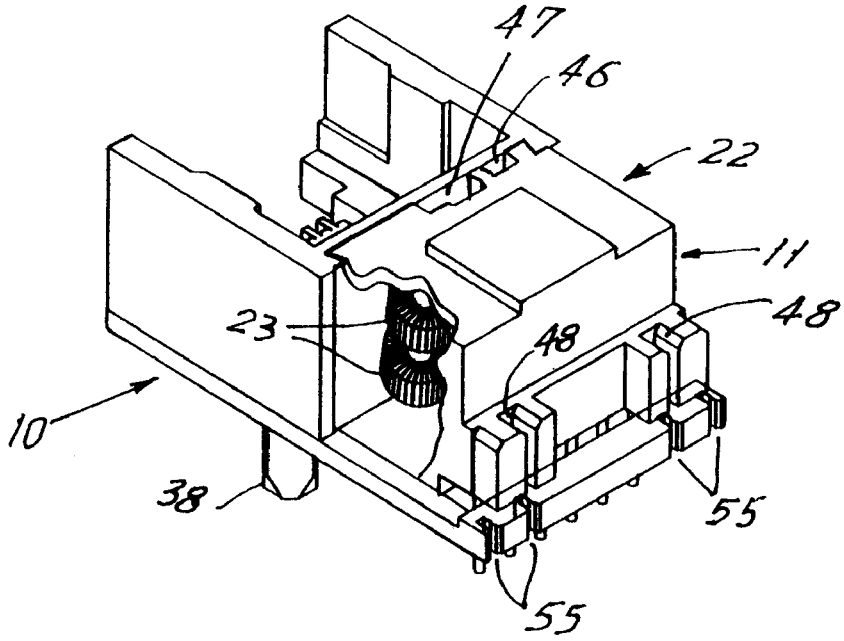
FIG. 3 is an exploded, rear perspective view of a combined contact pin block assembly and toroid base assembly forming part of the RJ jack with a portion broken away to show toroids housed within the toroid base assembly.

The toroid base assembly 11 includes a plastic housing 22 which houses a plurality of magnetic toroid units 23 (FIG. 3) functioning as filters or transformers which are connected by fine, multi-wrapped wires to a plurality of depending pins 24 (only one of which is shown) which extend downwardly from the toroid base assembly 11, the wires being dip soldered to the pins 24.

The toroid base assembly 11 includes on the front thereof a pair of opposing projections 26 and 27 having outer edges 28 and 29, respectively, which are dove-tailed to mate with the dove-tailed edges 21 of the side walls 13 of the contact pin block assembly 10 when the toroid base assembly 11 is assembled with the contact pin block assembly 10. More specifically, the toroid base assembly 11 is assembled with the contact block assembly 10 by being placed over the contact pin block assembly 10 and then being moved downwardly (as shown by the arrow) such that the projections 26 and 27 on the toroid base assembly 11 engage and mate with the dove-tailed edges 21 of the rearwardly projecting portions of the side walls 13 of the contact pin block assembly 10 to secure the toroid base assembly 11 to the contact pin block assembly 10.

Figure 4:
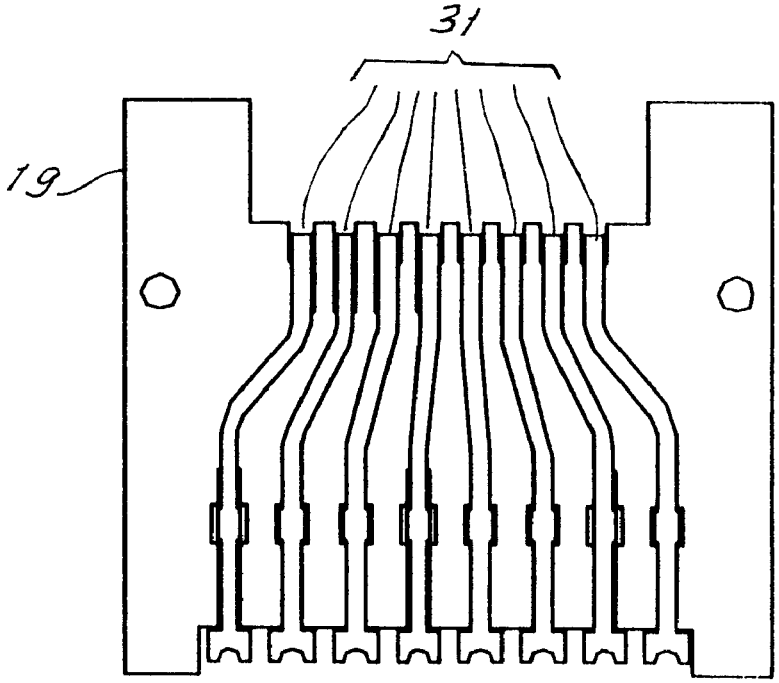
FIG. 4 is a plan view of the bottom side of a contact pin block assembly shown in FIG. 1(*a*) viewed from beneath the contact pin block assembly.

Referring to FIG. 1(*a*), the contact pin assembly 10 has a plurality of conductive contact fingers 31, which project upwardly in the chamber 17 at an angle towards the rear wall 14 of the contact pin block assembly 10 where they are received in respective slots (not shown). The contact fingers 31 extend downwardly over the front portion of the bottom wall 19 and then, as shown in FIG. 4, extend along the underside of the bottom wall 19 to the rear of the bottom wall 19.

The spacing between the contact fingers 31 within the chamber 17 corresponds to the spacing of the contacts in the modular plug to be received in the chamber 17. On the bottom of the bottom wall 19, however, as seen in FIG. 4, the spacing of the contact fingers 31 is increased so as to reduce cross-talk and facilitate connection to a printed wiring board (not shown).

After assembly of the toroid base assembly 11 to the contact pin block assembly 10, the resultant unit is then mounted to a bottom plate 33 (FIG. 1(*b*)). The plate 33 includes a plurality of openings 34 for receiving the depending pins 24 and four holes 36 for receiving four mounting posts 37 (only two of which are shown) depending from the bottom of the contact pin assembly 10 and the toroid base assembly 11. The plate 33 also has a pair of mounting posts 38 (only one of which is shown) for mounting the resultant assembly to, for example, a printed wiring board (not shown). The plate 33 also includes a front wall 39 for closing a cut-out 41 formed in the front wall 16 of the contact pin assembly 10.

Figure 5:
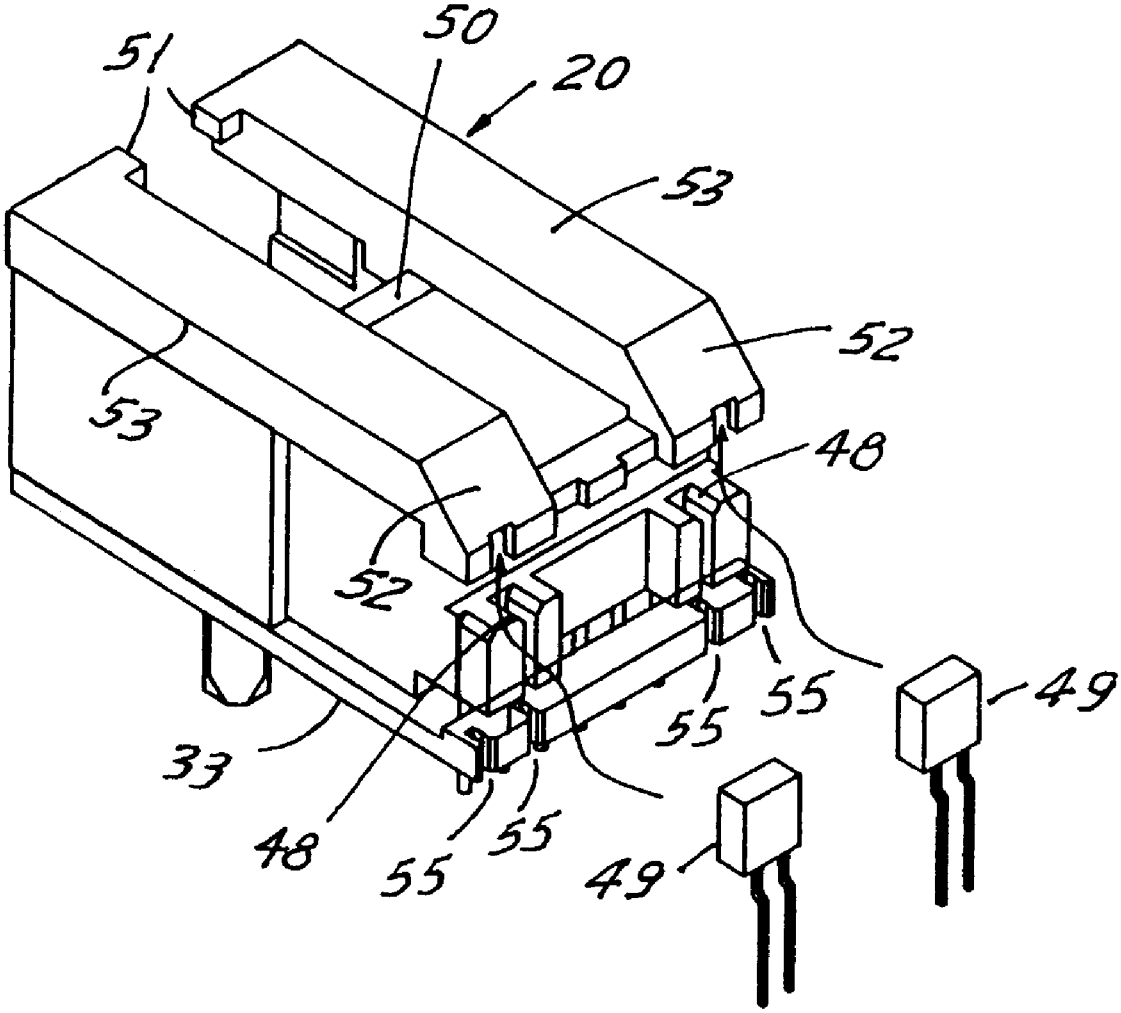
FIG. 5 is an exploded rear perspective veiw of the RJ jack showing LEDs that may be used with the RJ jack.

Referring to FIG. 5, the rear of the toroid base assembly includes a pair of guides 48 for respectively receiving both leads of a pair of LEDs 49, with the individual leads being received in slots 55 of the bottom plate 33.

Referring to FIG. 1(*c*), after assembly of the contact pin block assembly 10 and toroid base assembly 11 to the bottom plate 33, a shorting bar assembly 42 having dependent tabs 43 and 44 may be inserted into recesses 46 and 47 formed in the front of the toroid base assembly 11 in order to short or connect certain of the contact fingers 31 together.

Referring to FIG. 2(*a*), the RJ jack has a top wall 20 which is inserted over the assembled contact pin block assembly 10 and toroid base assembly 11. The top wall 20 functions as a stopper and locking mechanism for the plug (not shown) which is received in the interior chamber 17. More specifically, the top wall 20 includes a depending stopper 50, which limits or stops movement of the plug into the chamber 17. The top wall 20 also has a pair of opposing tabs 51, which function in a conventional manner as a locking mechanism which cooperates with a movable lever on the plug to releasably secure the plug in the chamber 17 of the RJ jack 58. In addition, the top wall 20 overlies the top of the contact fingers 31 in the slots in which they are received and prevents the contact fingers 31 from being pulled out of a slot when the plug is withdrawn from the chamber 17.

The top wall 20 is made of a clear or transparent plastic and includes a pair of depending rear portions 52 which extend over the LEDs 49 when the LEDs 49 are received in the guides 48 so that light from the LEDs 49 is transmitted through rectangular portions 53 of the top wall 20. The top wall 20 is mounted to the RJ jack by dependent projections 54 which are received in a pair of vertical bores 56 (only one of which is shown) formed in a shoulder 57 extending from the front of the rear wall 14 of the contact pin block assembly 10. The resultant assembly constitutes the RJ jack and is designated by the reference numeral 58.

Preferably, a metal shield 59 (FIG. 2(*b*)) may then be placed around the RJ jack 58 resulting in the shielded RJ jack 60 shown in FIG. 2(*c*).

Some of the advantages and features of the RJ jack are as follows.

The toroid units 23 are completely encapsulated in the toroid base assembly 11 with their fine interconnection wires multi-wrapped and dip soldered to the output pins.

The length of the contact fingers 31, which extend from the front wall 16 to the rear wall 14 of the contact pin block assembly 10, is made as short as possible. The spacing of the contact fingers 31 on the bottom of the bottom wall 19 is increased to provide signal isolation and reduce cross-talk.

The use of a clear top wall 20 for the RJ jack 58 allows the LEDs 49 to be mounted under the projections 52 at the back of the jack 58. This enables the LEDs 49 to be viewed from virtually any direction. Accordingly, sub-level and system testing, trouble shooting, etc. can be performed with the LEDs 49 continuously in view.

Further, since the LEDs 49 are not mounted integrally in the jack 58, but, instead are mounted under the projections 52 at the back of the RJ jack 58, a wide range of color combinations are possible to suit particular user applications. Additionally, for low cost applications, the RJ jack 58 can be used as a stand alone device without the LEDs 49.

Further, by not placing the LEDs 49 within the housing of the RJ jack 58 (i.e., the combined housings 12 of the contact block assembly 10 and the housing 11 of the toroid base assembly 11), there is no need to extend wires from the LEDs 49 through a wall of the housing. This simplifies manufacturing and assembly.

In addition, because the LEDs 49 and their leads are on the outside of the rear of the housing of the RJ jack 58, replacement of an LED 49 in the event that an LED 49 fails is relatively simple.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An RJ jack comprising:

a housing having bottom, side, rear, front and top walls and an interior chamber for receiving a plug through an opening in the front wall;

a plurality of contact fingers in the interior chamber for making contact with corresponding contacts in the plug;

at least two guides for receiving light emitting devices formed on the rear of the rear wall of the housing; and the top wall having a stopper for limiting movement of the plug within the chamber and a locking mechanism for releasably securing the plug within the chamber, the top wall being transparent and being structured and arranged for transmitting light from the light emitting devices.

2. An RJ jack comprising:

a first housing having bottom, side, rear and front walls defining an interior chamber and an opening through the front wall through which a plug may be received into the interior chamber;

a plurality of contact fingers extending from beneath the bottom wall to and over the front wall and into the interior of the chamber, the spacing between the contact fingers in the interior chamber being equal to the spacing of corresponding contacts in the plug with the spacing of the contact fingers extending beneath the bottom wall being substantially greater;

a second housing having a front wall secured to the rear wall of the first housing, the second housing containing a plurality of magnetic elements;

at least two guides for receiving light emitting devices formed on a rear wall of the second housing; and a top wall extending over the first and second housings, having a stopper for limiting movement of the plug within the chamber and a locking mechanism for releasably securing the plug within the chamber, the top wall being transparent for transmitting light from the light emitting devices.

3. An RJ jack according to claim 2, wherein the side walls of the first housing extend rearwardly and have respective dove-tailed portions for mating with complementary dove-tailed portions formed on the front wall of the second housing to thereby secure the second housing to the first housing.

4. An RJ jack according to claim 3, further including a shorting bar having depending tabs insertable through openings in a first wall of the second housing into contact with certain ones of the contact fingers to electrically interconnect such contact fingers.

5. An RJ jack according to claim 4, further including a base plate to which the first and second housings are mounted, the base plate having depending elements for mounting the RJ jack to another component.

6. A shielded RJ jack comprising the RJ jack of claim 5 and a shield for enclosing said RJ jack.

7. An RJ jack comprising:

a first housing having bottom, side, rear and front walls defining an interior chamber and an opening through the front wall through which a plug may be received into the interior chamber;

a plurality of contact fingers extending from beneath the bottom wall to and over the opening of the front wall and into the interior chamber, the spacing between the contact fingers in the interior chamber being equal to the spacing of corresponding contacts in the plug with the spacing of the contact fingers extending beneath the bottom wall being substantially greater;

a second housing having a front wall removably secured to the rear wall of the first housing, the second housing containing a plurality of magnetic elements; and a shorting bar having depending tabs insertable through openings in the front wall of the second housing into contact with certain ones of the contact fingers to electrically interconnect such contact fingers.

8. An RJ jack according to claim 7, wherein the first housing has a top wall which is structured and arranged relative to the contact fingers such that the contact fingers are prevented from being pulled from retaining slots for the contact fingers when the plug is withdrawn therefrom.

9. An RJ jack comprising:

a first housing having bottom, side, rear and front walls defining an interior chamber and an opening through the front wall through which a plug may be received into the interior chamber;

a plurality of contact fingers extending from beneath the bottom wall to and over the opening of the front wall and into the interior chamber, the spacing between the contact fingers in the interior chamber being equal to the spacing of corresponding contacts in the plug with the spacing of the contact fingers extending beneath the bottom wall being substantially greater;

a second housing having a front wall removably secured to the rear wall of the first housing, the second housing containing a plurality of magnetic elements, the side walls of the first housing extending rearwardly and have respective dove-tailed portions for mating with complementary dove-tailed portions formed on the front wall of the second housing to thereby secure the second housing to the first housing; and a shorting bar having depending tabs insertable through openings in the front wall of the second housing into contact with certain ones of the contact fingers to electrically interconnect such contact fingers.

10. An RJ jack according to claim 9, further including a base plate to which the first and second housings are mounted, the base plate having depending elements for mounting the RJ jack to another component.

11. A shielded RJ jack comprising the RJ jack of claim 10 and a shield for enclosing said RJ jack.

* * * * *